United States Patent [19]

Johnson

[11] Patent Number: 4,551,880

[45] Date of Patent: Nov. 12, 1985

[54] VERTICAL WORKPIECE CLEANSER AND DRYER

[75] Inventor: Gerald E. Johnson, Flint, Mich.

[73] Assignee: Lamb Technicon Corp., Warren, Mich.

[21] Appl. No.: 543,629

[22] Filed: Oct. 20, 1983

[51] Int. Cl.[4] ..... A47L 5/14

[52] U.S. Cl. ..... 15/302; 15/306 B; 134/70; 134/99

[58] Field of Search ..... 15/302, 306 B; 134/70, 134/94, 124, 131, 104, 95, 99, 133

[56] References Cited

U.S. PATENT DOCUMENTS

| | | | |
|---|---|---|---|
| 1,260,606 | 3/1918 | Walstad | 134/124 |
| 1,852,405 | 4/1932 | Farley | 134/124 |
| 1,864,064 | 6/1932 | Hall | 134/133 X |
| 2,363,631 | 11/1944 | Walters | 15/302 U X |
| 3,059,654 | 10/1962 | Weiner | 134/131 X |
| 3,132,655 | 5/1964 | Anderson | 134/82 X |
| 3,350,224 | 10/1967 | Sadwith | 134/131 X |
| 3,464,428 | 9/1969 | Kraeft | 134/133 X |
| 4,080,974 | 3/1978 | Oag | 134/70 X |
| 4,233,084 | 11/1980 | Bergsand | 134/70 X |
| 4,409,775 | 10/1983 | Brody et al. | 134/73 X |

FOREIGN PATENT DOCUMENTS

| | | | |
|---|---|---|---|
| 67239 | 7/1948 | Denmark | 134/131 |
| 662211 | 12/1951 | United Kingdom | 134/131 |

*Primary Examiner*—Philip R. Coe
*Assistant Examiner*—Frankie L. Stinson
*Attorney, Agent, or Firm*—Barnes, Kisselle, Raisch, Choate, Whittemore & Hulbert

[57] ABSTRACT

A vertical workpiece cleanser and dryer which includes a pair of chain-driven pocket elevators disposed in adjacent wash and rinse towers on bases which enclose associated wash and rinse solution reservoirs. Each elevator includes a plurality of spools cantilevered from a drive chain and extending in a vertical upwardly directed reach through a solution (wash or rinse) spray zone and then through an air spray zone for removing solution from the workpiece and elevator spools. The elevator within the solution spray zone is closely encompassed by a surrounding shroud for limiting volume available for expansion of sprayed solution, and thus reducing the tendency of the sprayed solution to vaporize. Vertical orientation of the elevator and alignment of the solution and air spray zones promote downward flow of excess solution through the solution spray zone for enhanced flush-washing of the workpieces, and return of excess solution to the associated reservoir disposed therebeneath. This downward solution flow is enhanced and promoted by closed circulation of drying air, which is directed onto the workpieces at a pressure of less than two atmospheres so as to reduce tendency of the solution removed from the workpieces to vaporize. As a result, vaporization of the wash and/or rinse solutions is substantially eliminated, and the vertical cleansing apparatus of the invention does not require ventilation to outside atmosphere.

12 Claims, 6 Drawing Figures

VERTICAL WORKPIECE CLEANSER AND DRYER

The present invention is directed to apparatus for cleansing workpieces, and more particularly to apparatus for washing and/or rinsing and drying workpieces while elevating the same for gravity feed to subsequent work stations.

A general object of the present invention is to provide an apparatus for cleansing—i.e. washing and/or rinsing and drying—workpieces which occupies a reduced amount of space on the plant floor as compared with conventional and commonly used horizontal washers and dryers.

Another object of the invention is to provide a basic design for a workpiece cleansing apparatus which is readily adaptable at the time of manufacture for use in conjunction with a variety of workpiece geometries without requiring major redesign for each application.

Another important object of the present invention is to provide a workpiece cleansing apparatus which does not require ventilation to the outside atmosphere. In furtherance of the foregoing, another and more specific object of the invention is to provide apparatus for washing and/or rinsing and drying workpieces which is so constructed as to reduce or eliminate substantial vaporization of the cleansing solutions during the wash, rinse and drying operations.

Further utilizing the foregoing objects involving a reduced floor space requirement and elimination of the need for outside ventilation, yet another object of the invention is to provide portable workpiece cleansing apparatus which may be readily relocated as conditions require.

The invention, together with additional objects, features and advantages thereof, will be best understood from the following description, the appended claims and the accompanying drawings in which:

Figure 2:
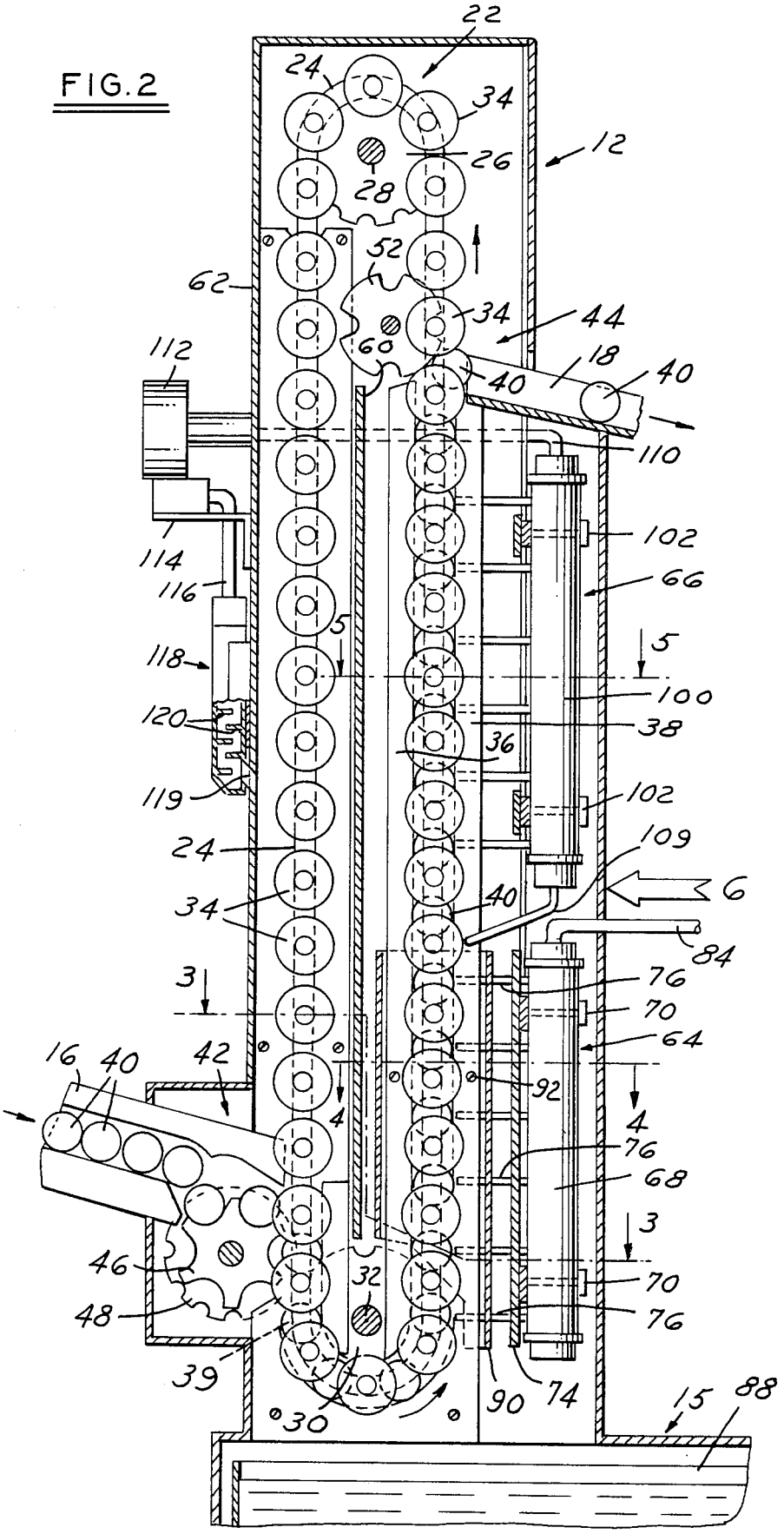
FIG. 2 is a sectional view in side elevation of a portion of FIG. 1 taken substantially along the line 2—2 in FIG. 1.
Figure 3:
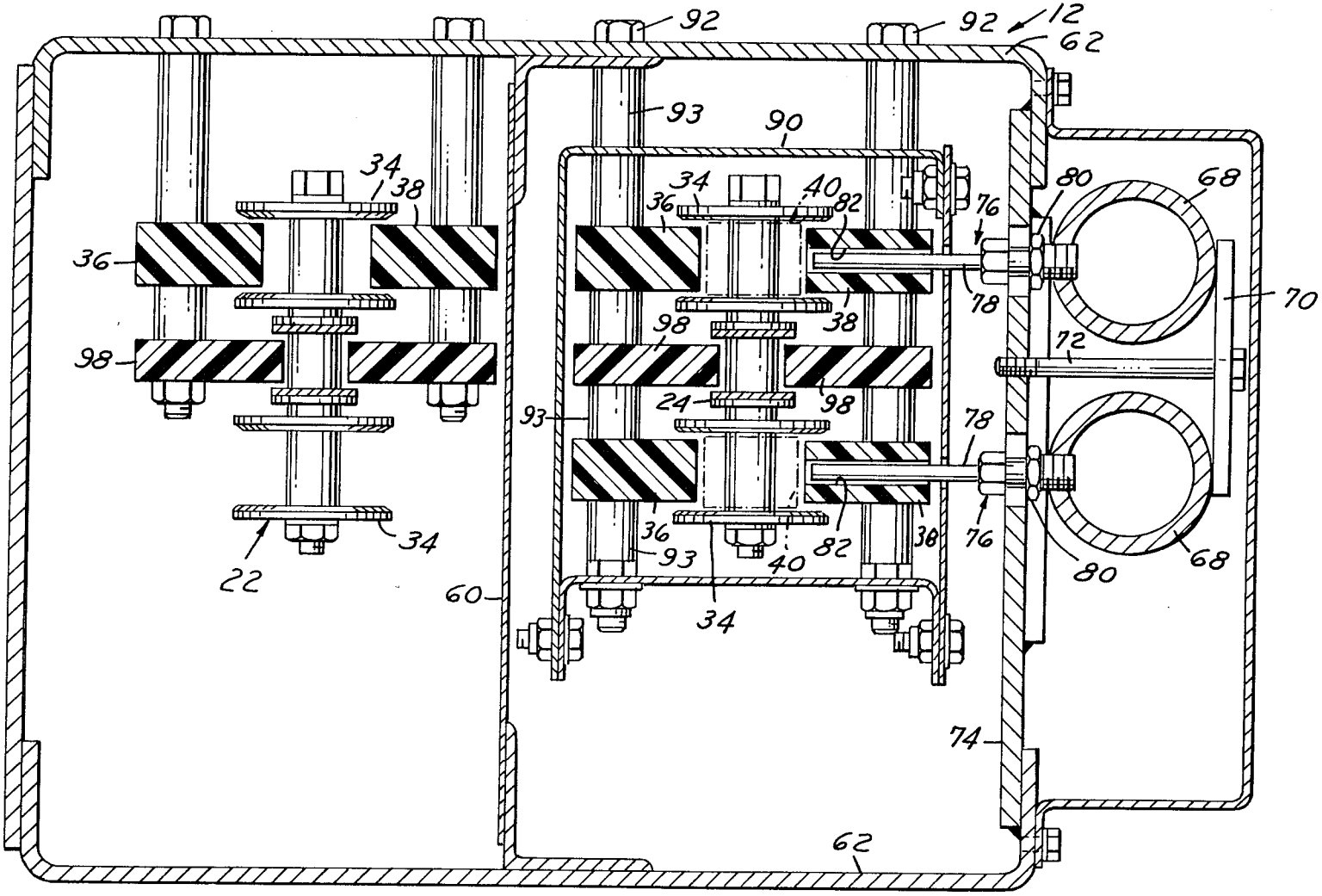
Figure 4:
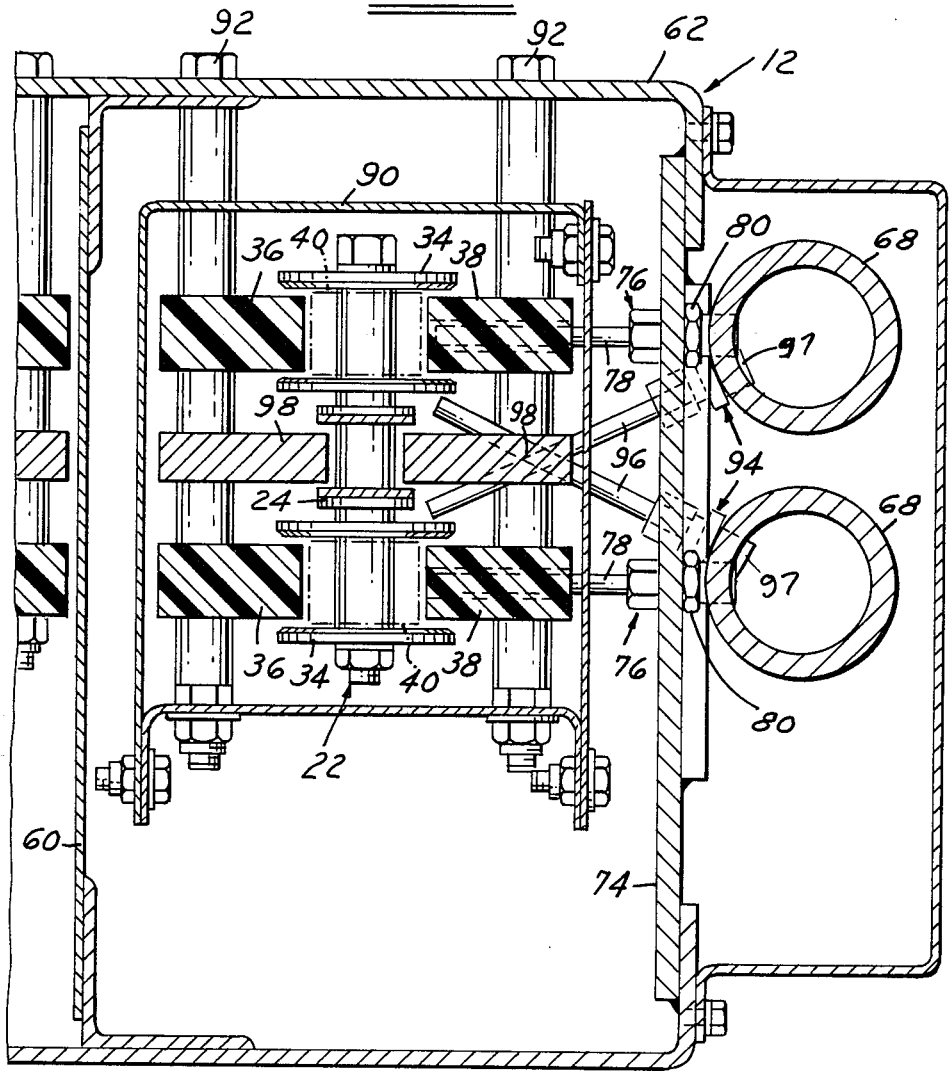
Figure 5:
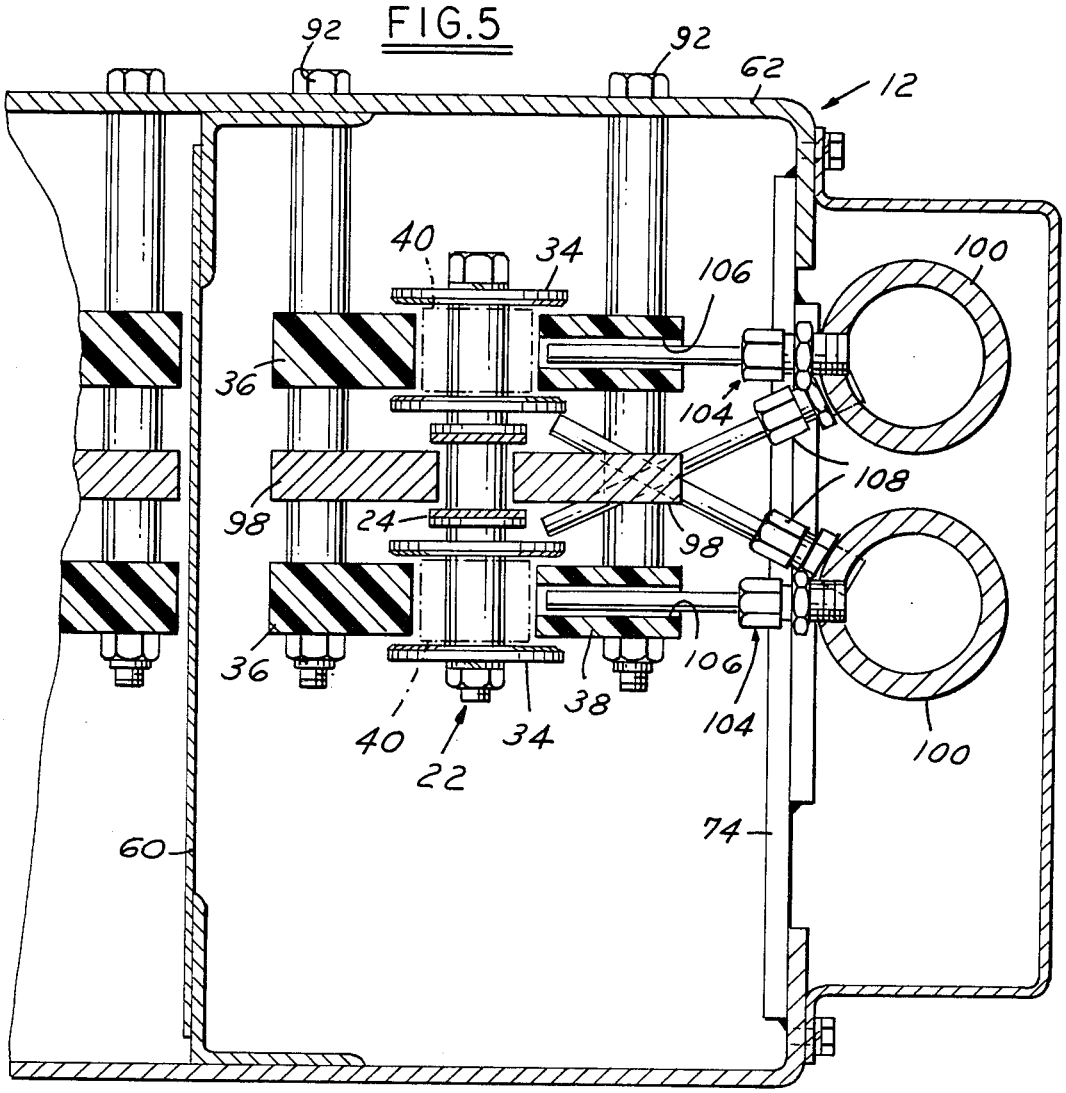
Figure 6:
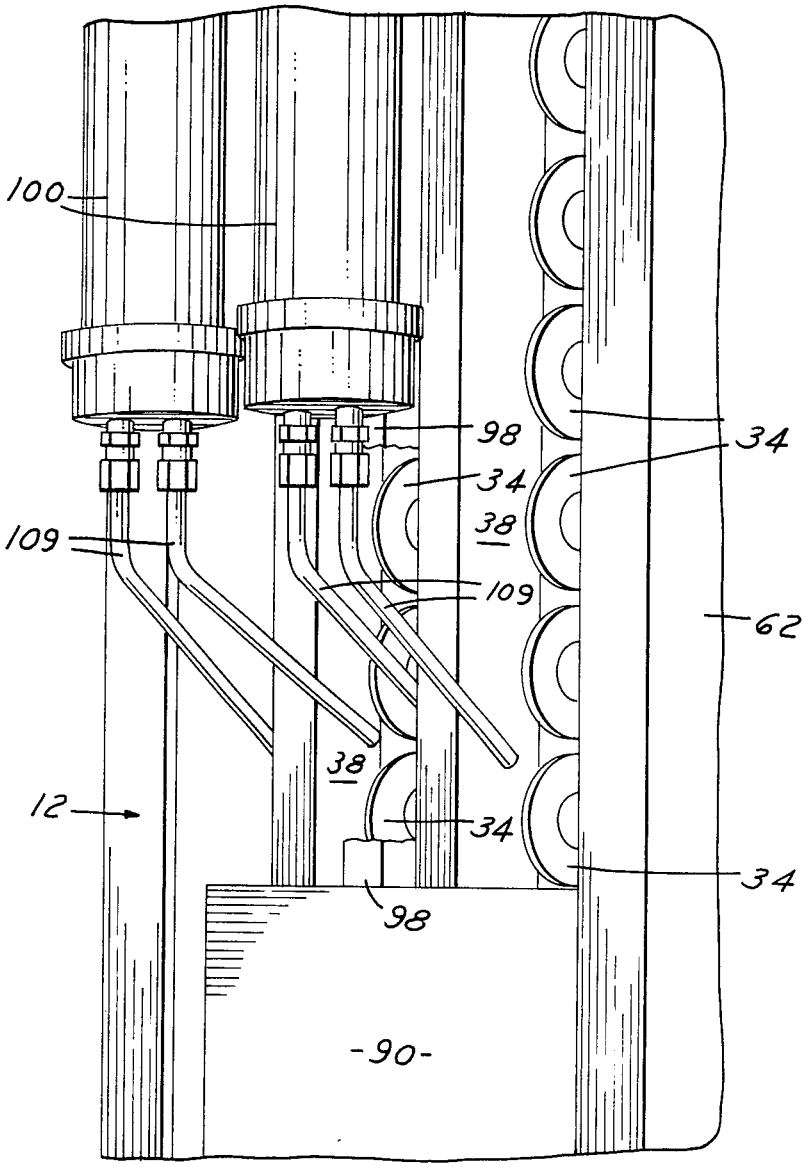

FIGS. 3, 4 and 5 are sectional views taken along the respective lines 3—3, 4—4 and 5—5 in FIG. 2; and FIG. 6 is a fragmentary perspective view on an enlarged scale taken substantially from the direction 6 in FIG. 2.

Figure 1:
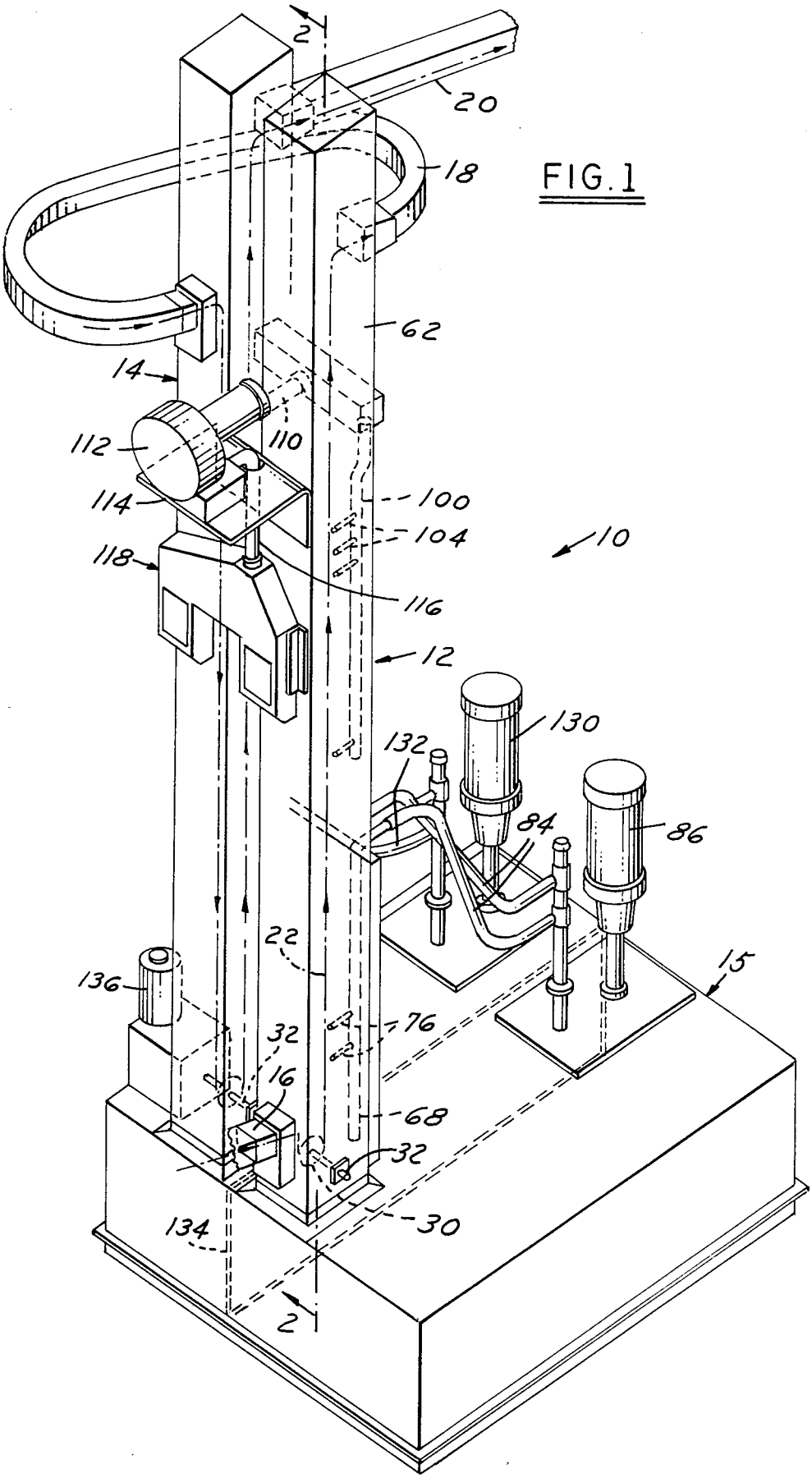
FIG. 1 is a perspective view of a presently preferred embodiment of a workpiece washer and dryer in accordance with the present invention.

FIG. 1 illustrates a presently preferred embodiment 10 of workpiece cleansing apparatus in accordance with the invention as comprising a pair of generally rectangular enclosed towers 12,14 projecting side-by-side vertically upwardly from a hollow enclosed base 15. Workpieces to be cleansed are fed to tower 12 by the inlet chute 16, are washed and dryed within tower 12 while simultaneously being elevated, and are ejected therefrom to the chute 18. Workpieces are fed by chute 18 by force of gravity to the inlet of tower 14, wherein workpieces are rinsed and dried and simultaneously elevated to outlet chute 20 which feeds cleansed workpieces by force of gravity to further processing or storage locations. FIGS. 2–6 illustrate details of wash and dry tower 12, rinse and dry tower 14 being substantially identical thereto in all important respects.

A chain-driven pocket elevator 22 within tower 12 comprises an endless chain 24 looped around an upper idler sprocket 26 rotatable on a fixed shaft 28 and a lower sprocket 30 coupled to the drive shaft 32. A plurality of spools 34 are cantilevered in axial pairs on opposing sides of chain 24 (FIG. 3) with the spool axes being perpendicular to the plane of motion of chain 24 around sprockets 26,30. Spools 34 are spaced from each other lengthwise of chain 24 and cooperate with the part guides 36,38 to define part-receiving pockets 39 between the guides and between successive spools for receiving and transporting workpieces 40 between the inlet station 42 and the outlet station 44. Inlet station 42 includes a pair of axially spaced starwheels 46 coupled by a sprocket 48 to rotate in synchronism with motion of chain 24 so as to feed individual workpieces 40 from inclined inlet chute 16 to the workpiece-receiving pockets 39 between successive spools 34. The workpieces 40 are thus captured in the part-receiving pockets and transported downwardly around sprocket 30 and then upwardly between guides 36,38 to eject station 44. A second pair of axially spaced starwheels 52 at station 44 is coupled to spools 34 above chute 18 and has fingers which enter successive elevator pockets so as to displace workpieces 40 from within the pockets onto outlet chute 18. To the extent thus far described, elevator 22 is substantially identical to that disclosed in the copending application of the inventor herein, Ser. No. 457,969 filed Jan. 14, 1983 and assigned to the assignee hereof. The disclosure of such copending application is incorporated herein by reference, and reference is made thereto for a more detailed discussion of the mechanical structure and operation of pocket elevator 22 per se.

A baffle 60 separates the upwardly traveling reach of elevator 22 on the right-hand side of FIG. 2 from the downwardly traveling reach within the rectangular enclosure 62 of tower 12. The upwardly traveling reach of elevator 22 successively traverses a wash station 64 and a drying station 66 between drive sprocket 32 and eject station 44. Referring in particular to FIGS. 1–4, wash station 64 comprises a pair of tubular manifolds 68 affixed by the straps 70 and the bolts 72 to the wall 74 of enclosure 62 so as to extend parallel to and in alignment with the paths of paired spools 34 between guides 36,38. A plurality of wash solution spray jets on manifolds 68 are disposed along the path of elevator spools 34 between guides 36,38 so as to direct cleansing solution onto workpieces 40 as the workpieces are carried therepast within the elevator pockets 39. Each jet 76 comprises a steel tube 78 connected to an associated manifold 68 by a fitting 80 and extending therefrom through an opening 82 in guide 38 to terminate adjacent the workpiece guide surface of guide 38. Manifolds 68 are connected by the hose 84 (FIGS. 1 and 2) to the pump 86 which conveys cleansing solution from a reservoir 88 (FIG. 2) to manifolds 68 and through jets 76 onto the workpieces 40 carried by elevator 22.

Elevator 22 is surrounded throughout the length of wash station 64 by a generally rectangular shroud 90 which is open at both ends to permit extension of the elevator chain and guide rails therethrough. Shroud 90 and guide rails 36,38 are affixed to the sidewall of enclosure 62 by the bolts 92 and spacer bushings 93, as best seen in FIGS. 3 and 4. The embodiment of the invention illustrated in the drawings is specifically adapted for cleansing of automotive transmission pinion gears which have a central bore extending axially therethrough. Spray jets 76, which extend perpendicularly and centrally to the periphery of the pinion gear workpieces 40, affect a rocking and spinning action of the gears by the force of impingement of solution onto the toothed outer peripheries of the pinion gears. In order to cleanse the central bores of the pinion gears, additional spray jets 94 (FIG. 4) are provided and comprise respective tubes 96 affixed to manifolds 68 by the fittings 97 and extending angularly through slots in the chain guide rail 98 to adjacent the inside spool face of the opposing spool array. Thus, as the spools 34 pass jets 94, the jets spray cleansing solution between adjacent spools onto and through the bores of the pinion gear workpieces 40 carried therebetween. Shroud 90 and tower enclosure 62 are open at the lower end so as to permit the cleansing solution to drain by gravity into reservoir 88 which is disposed therebeneath.

Drying station 66 (FIGS. 1–2 and 5–6) is positioned immediately above wash station 64 in the upward path of elevator 22 and comprises a pair of tubular air manifolds 100 affixed by the straps 102 (FIG. 2) to tower enclosure wall 74 parallel to and laterally aligned with the paths of paired elevator spools 34. A plurality of air jets 104 extend from manifolds 100 through openings 106 in guide rails 38, and are substantially identical to solution spray jets 76 previously described. Likewise, angulated air jets 108 are affixed to manifolds 100 and extend angularly through chain guide rail 98 to direct drying air into the bores of successive pinion gear workpieces 40 in the specific embodiment of the invention illustrated in the drawings. Thus, air jets 104,108 blow cleansing solution off of the successive workpieces 40 (and off of the elevator spools) so as to effect drying thereof prior to and during transportation to eject station 44. A pair of supplementary angulated air jets 109 (FIGS. 2 and 6) project from the lower end of each air manifold 100 and are oriented around guide rails 38 so as to blow cleansing solution off of the outside faces of successive elevator spools 34 as the latter exit wash station 64. The upper ends of air manifolds 100 are connected by the air conduit 110 to an air pump or blower 112 mounted on a shelf 114 on the external face of tower enclosure 62 above workpiece inlet station 42. Pump 112 is connected by the conduit 116 to an inlet manifold 118. The air inlet 119 to manifold 118 is disposed at the lower end thereof adjacent to workpiece inlet station 42 and is angulated downwardly through the wall of enclosure 62 in the direction of the workpiece inlet. A multiplicity of baffles 120 project from the walls of manifold 118 so that air from inlet 119 is caused to traverse a tortuous path to conduit 116 and pump 112.

In operation of wash/dry tower 12, workpieces 40 are transported by elevator 22 through wash station 64 and drying station 66, and then discharged at eject station 44. Shroud 90 which closely surrounds elevator 22 within the vertical extent of wash station 64 functions to limit the volume of the space available for expansion of cleansing solution released by jets 76,94 so as to reduce and substantially eliminate the tendency of the cleansing solution to vaporize within the wash station. The cleansing solution confined within shroud 90 falls by gravity, and thus not only provides enhanced cleaning by flushing action of workpieces traveling upwardly in the opposing direction, but also drains through the open lower ends of shroud 90 and enclosure 62 to reservoir 88 for reuse. It will also be appreciated that the spray jets 76,94 are of substantially uniform tubular diameter and terminate closely adjacent to the path of workpieces 40 so as to reduce any tendency of the sprayed solution to expand and vaporize prior to impingement upon the workpieces. As the workpieces exit wash station 64 and enter drying station 66, air is directed by manifolds 100 and jets 104,108 and 109 onto the workpieces and the elevator spools for removing or blowing off cleansing solution. Such air preferably is directed onto the workpieces at a pressure of less than two atmospheres (but greater than one atmosphere) at high velocity and high volume. Such low-pressure air reduces the tendency of the drying jets to atomize cleansing solution removed from the workpieces and elevator spools. Thus, the cleansing solution blown off of the workpieces and elevator remains in droplet form and falls by gravity toward and through wash station 64 to reservoir 88 for reuse. A portion of the falling droplets pass through shroud 90, thereby enhancing the flush-cleansing action previously described.

The return of cleansing solution to reservoir 88 in droplet form and without substantial vaporization is further enhanced by continuous closed circulation of drying air from manifolds 100 and jets 104,108,109 downwardly around the lower end of center baffle 60 and then upwardly to the downwardly angulated inlet 119 of manifold 118. The downwardly-directed air stream through wash station 64 assists gravity return of solution to tank 88. The cross-sectional resistance to air flow directly above reservoir 88 is substantially less than within the wash and dry stations, so that the velocity of the air stream directly above reservoir 88 is reduced and the entrained droplets have greater opportunity to fall into the reservoir. Any droplets of solution remaining in the air at inlet 119 to manifold 118 are removed by impingement with the baffles 120, and flow back through the angulated inlet 119 and fall downwardly past workpiece feed station 42 toward reservoir 88.

Workpieces washed and dried in tower 12 are ejected to chute 18 and gravitate to the inlet of tower 14. Within tower 14, the workpieces are transported downwardly at one side of central baffle 60 and then upwardly at the opposite side thereof through rinse and dry stations, which are identical in all respects to wash and dry stations 64,66 previously described. Referring to FIG. 1, a liquid rinse reservoir (not shown) within base 15 and directly below tower 14 is connected by the pump 130 and the hoses 132 to associated rinse manifolds identical to the tubular wash manifolds 68. The wash and rinse solution reservoirs are separated within base 16 by the baffles 134 (FIG. 1). Air inlet manifold 118 has a branch coupled to rinse/dry tower 14 as best seen in FIG. 1, and air pump 112 feeds drying air to the drying stations in both towers 12 and 14. The drive sprocket of the pocket elevator within tower 14, which is identical to elevator 22 in tower 12 with exception of positioning of the workpiece inlet and outlet stations, is coupled by the common drive shaft 32 together with drive sprocket 30 of elevator 22 to a drive motor 136. Rinse and dry tower 14 operates in all respects in a manner analogous to that previously described in detail in connection with wash and dry tower 12.

There has thus been provided in accordance with the present invention a workpiece cleansing and drying apparatus which fully satisfies all of the objects and aims previously set forth. In particular, the invention substantially eliminates the vaporization of wash and rinse solutions which is characteristic of prior art cleansing apparatus of both horizontal and vertical construction. A 12-foot embodiment of the invention, which is shown substantially to scale in the drawings, has been operated continuously for several hours at a time to wash, rinse and dry pinion gear workpieces within a closed shop during the winter months and without external ventilation without causing above-normal condensation on the shop windows. Absence of any requirement for ventilation and relatively small size permits relocation as desired without use of much floor space.

It will be appreciated that the present invention encompasses both separate washing and rinsing operations, as in the embodiment herein disclosed, as well as a combined wash rinse operation using an appropriate solution. In such an application, only one tower need be employed. Indeed, the term "cleansing" as used in the present application is intended to encompass separate washing and rinsing operations, individually and in combination, as well as a combined wash/rinse operation. It is also envisioned in practice of the invention that the separate towers 12,14 illustrated in FIG. 1 may be combined as one structure, with a suitable wall or baffle being positioned within the combined tower enclosure so as to separate the wash and rinse sections. Likewise, details of pocket elevator 22 are disclosed for illustrative purposes only, and do not limit the scope of the present invention.

It will also be appreciated that the overall design concept embodied in the invention herein disclosed is readily adaptable for use in conjunction with a variety of workpiece geometries. In this connection, it is noted that the size, number and orientation of the cleansing and drying jets, and even the provision of angulated jets 94,108, are determined by workpiece geometry and are not critical to the invention. Indeed, the invention is intended to encompass all modifications and variations as fall within the spirit and broad scope of the appended claims.

The invention claimed is:

1. A vertical workpiece cleanser and dryer comprising a closed walled tower, an elevator including a plurality of pockets, means for translating said pockets through a closed path within said tower, which path includes at least one portion in which said pockets are translated vertically upwardly, and means for feeding workpieces to be cleansed into said tower to successive ones of said pockets upstream of said one portion, a first plurality of jets spaced from each other along a lower section of said one path portion within said tower and means for directing a cleansing solution through said first plurality of jets onto workpieces carried in said pockets through said lower path section, and a second plurality of jets spaced from each other along an upper section of said one path portion within said tower directly above said lower section, an air pump connected for directing air under pressure through said second plurality of jets onto workpieces carried in said pockets through said upper path section, air inlet means connected to and opening into said tower at a position spaced from and communicating with said one path portion so as to effect closed circulation of drying air from said second plurality of jets to said inlet means through said tower, such that cleansing solution removed from the workpieces by said second plurality of jets in said upper path section, and cleansing solution in said lower path section, fall by gravity through said lower section around said pockets and parts in said lower path section thereby flush-cleansing workpieces in said lower path section, said inlet means being positioned and directed on said tower so as to promote downward flow of drying air from said jets through said lower path section so as to enhance downward flow of cleansing solution in said upper and lower sections.

2. The vertical cleanser and dryer set forth in claim 1 wherein said air pump is constructed to direct air through said second plurality of jets onto workpieces in said upper path section at a pressure which is sufficiently low to prevent atomization and substantial vaporization of cleansing solution blown off of workpieces in said upper path section.

3. The vertical cleanser and dryer set forth in claim 2 wherein said pressure is less than two atmospheres.

4. The vertical cleanser and dryer set forth in claim 2 further comprising a shroud having closed sides encompassing said lower path section in relatively close relation so as to limit volume of space available for expansion of cleansing solution exiting from said first plurality of jets and thereby prevent substantial vaporization of cleansing solution in said lower path section.

5. The vertical cleanser and dryer set forth in claim 1 further comprising a closed cleansing solution reservoir positioned beneath and open to said tower.

6. A vertical workpiece cleanser and dryer comprising a pocket elevator which includes a plurality of spools, drive means mounting said spools at uniform spacing with respect to each other, means for translating said drive means and said spools through a closed path, and guide means disposed adjacent to said path and cooperating with said spools to capture workpieces transported along said path, at least a first portion of said path including said guide means extending vertically upwardly and an adjacent parallel second portion of said path extending vertically downwardly, a tower enclosing said elevator including both of said path portions, with a baffle in said tower separating said first and second path portions, a first plurality of jets extending through said guide means and terminating adjacent to said path in a lower section of said first portion, and means for directing cleansing solution through said first plurality of jets and through said guide means onto workpieces in said lower section of said first path portion, and a second plurality of jets extending through said guide means and terminating adjacent to said path in an upper section of said first path portion directly above said lower section, and means for directing air under pressure through said second plurality of jets and through said guide means onto workpieces in said upper section so as to blow cleansing solution off of said workpieces, said air being at a pressure which is sufficiently low as to prevent atomization and substantial vaporization of cleansing solution within said upper section, said air directing means including an air pump connected with said second jets and having an air inlet positioned in said second path portion and oriented to promote circulation of air downwardly in said first portion and upwardly in said second path portion to effect closed circulation of drying air through said tower, such that cleansing solution removed from the workpieces by said second plurality of jets and cleansing solution in said lower path section are urged by the combined effect of air circulation and gravity downwardly through said lower path section.

7. The vertical cleanser and dryer set forth in claim 6 further comprising a closed reservoir disposed beneath said tower and open to said tower for receiving said removed and excess cleansing solution.

8. The vertical cleanser and dryer set forth in claim 7 further comprising a shroud enclosing said lower path section of said elevator in relatively close relation so as to limit volume of space available for expansion of cleansing solution in said lower path section and thereby eliminate substantial vaporization of cleansing solution in said lower path section.

9. The vertical cleanser and dryer set forth in claim 7 wherein said air pressure of said air jets is less than two atmospheres.

10. The vertical cleanser and dryer set forth in claim 8 comprising laterally adjacent and separately enclosed wash and rinse towers, each having associated said elevators, reservoirs and pluralities of jets, said wash tower having a workpiece outlet and said rinse tower having a workpiece inlet and means for feeding workpieces from the outlet of said wash tower to the inlet of said rinse tower.

11. The vertical cleanser and dryer set forth in claim 10 wherein said elevator comprises an endless chain and a plurality of spools regularly spaced along said chain.

12. The vertical cleanser and dryer set forth in claim 11 comprising first and second pluralities of spools cantilevered in coaxial pairs on opposite sides of said chain, each of said pluralities defining a said closed path and having guide means and first and second pluralities of jets associated therewith.

* * * * *